United States Patent [19]

Pfaff et al.

[11] Patent Number: 4,729,943

[45] Date of Patent: Mar. 8, 1988

[54] COLOR IMAGE-FORMING PHOTOGRAPHIC REVERSAL ELEMENT WITH IMPROVED INTERIMAGE EFFECTS

[75] Inventors: Maurice Pfaff, Le Perreux-sur-Marne; Régis Thomas, Chalon-sur-Saone, both of France

[73] Assignee: Eastman Kodak Company, Rochester, N.Y.

[21] Appl. No.: 915,442

[22] Filed: Oct. 6, 1986

[30] Foreign Application Priority Data

Dec. 9, 1985 [FR] France ..... 8518297

[51] Int. Cl.[4] ..... G03C 7/00; G03C 1/46

[52] U.S. Cl. ..... 430/362; 430/379; 430/504; 430/505; 430/506; 430/957

[58] Field of Search ..... 430/504, 505, 506, 957, 430/362, 379

[56] References Cited

U.S. PATENT DOCUMENTS

| | | | |
|---|---|---|---|
| 2,449,966 | 9/1948 | Hanson | 430/359 |
| 2,600,606 | 6/1952 | Balon | 260/124 |
| 3,148,062 | 9/1964 | Whitmore et al. | 430/382 |
| 3,227,554 | 1/1966 | Barr et al. | 430/382 |
| 3,932,185 | 1/1976 | Matsuura | 430/505 |
| 4,250,252 | 2/1981 | Odenwälder | 430/505 |
| 4,310,621 | 1/1982 | Odenwälder | 430/443 |
| 4,490,459 | 12/1984 | Iijima | 430/505 |

FOREIGN PATENT DOCUMENTS

| | | | |
|---|---|---|---|
| 2222674 | 4/1981 | France | 430/504 |
| 1044778 | 10/1966 | United Kingdom . | |

OTHER PUBLICATIONS

Barr, Thirtle & Vittum in Photog. Sc. & Eng., vol. 13, pp. 74–80 & 214–217, (1969).

*Primary Examiner*—Paul R. Michl
*Assistant Examiner*—Patrick Doody
*Attorney, Agent, or Firm*—Harold E. Cole

[57] ABSTRACT

A reversal photographic element comprising at least two dye image-forming units, at least one unit comprising (1) a first silver halide emulsion layer spectrally sensitized to a given region of the spectrum with which is associated a dye image-forming chromogenic coupler and (2) a second silver halide emulsion layer spectrally sensitized to a different region of the spectrum than the first and containing an interimage effect-forming means such as a development inhibitor-releasing coupler, which forms either a colorless compound or a dye which does not substantially take part in the formation of the image.

14 Claims, 16 Drawing Figures

Figure 1:
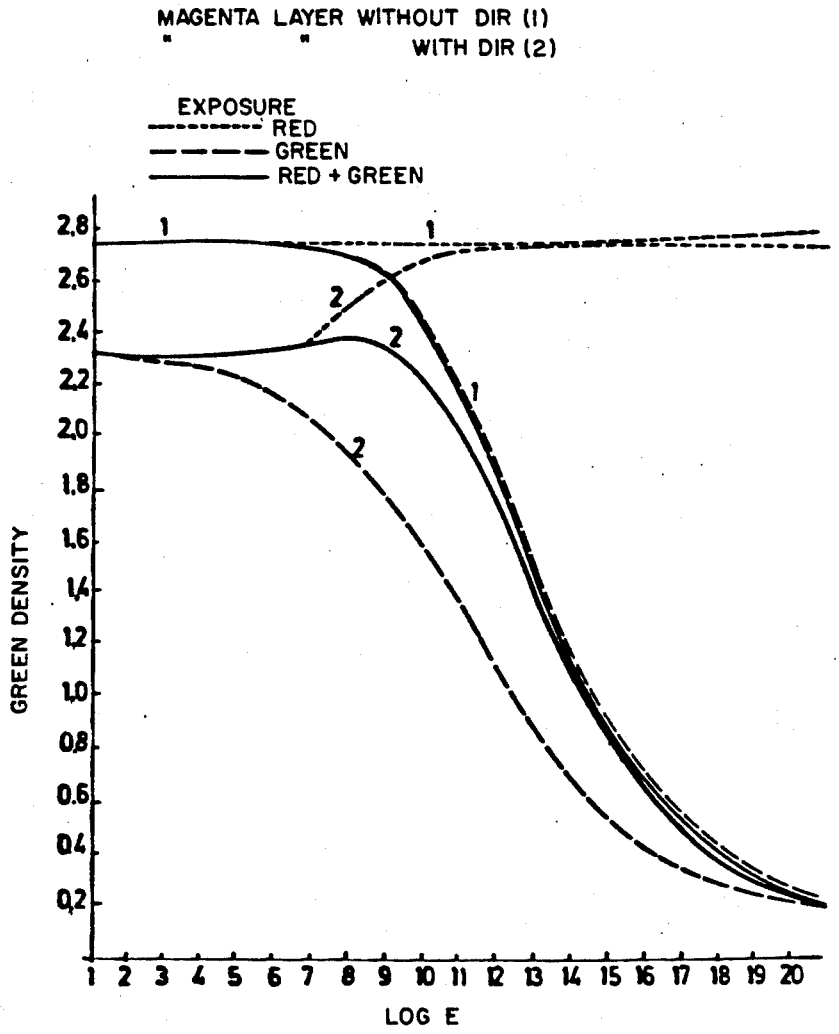
Figure 2:
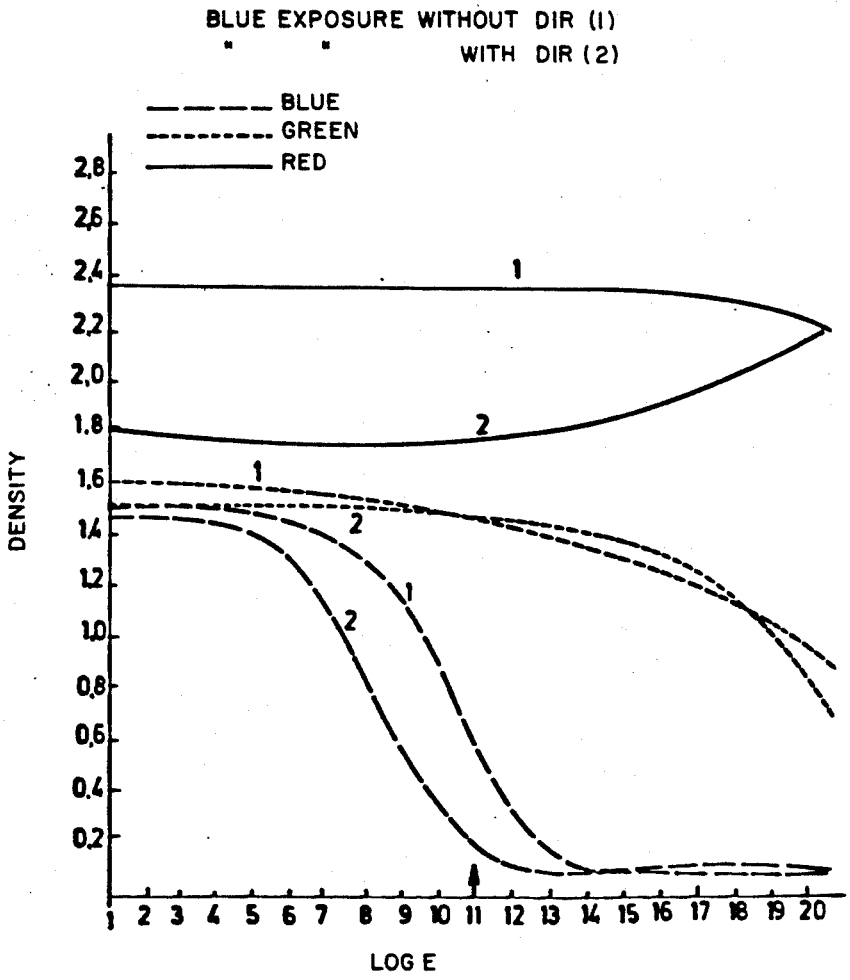
Figure 3:
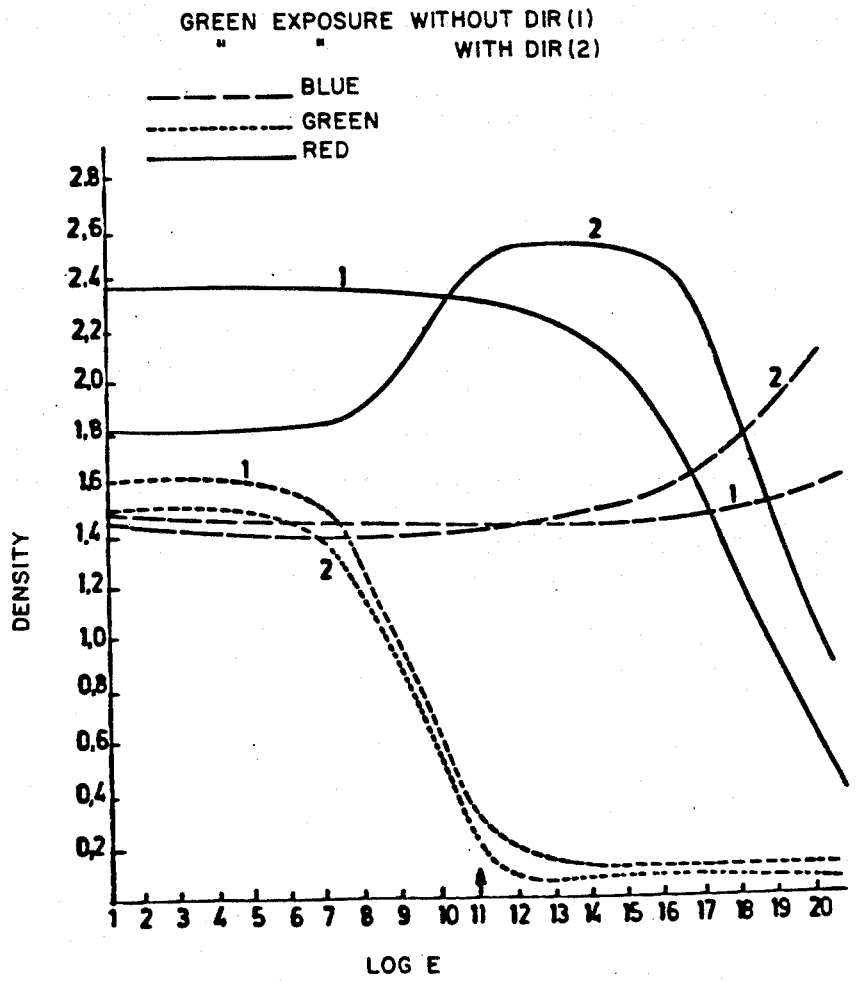
Figure 4:
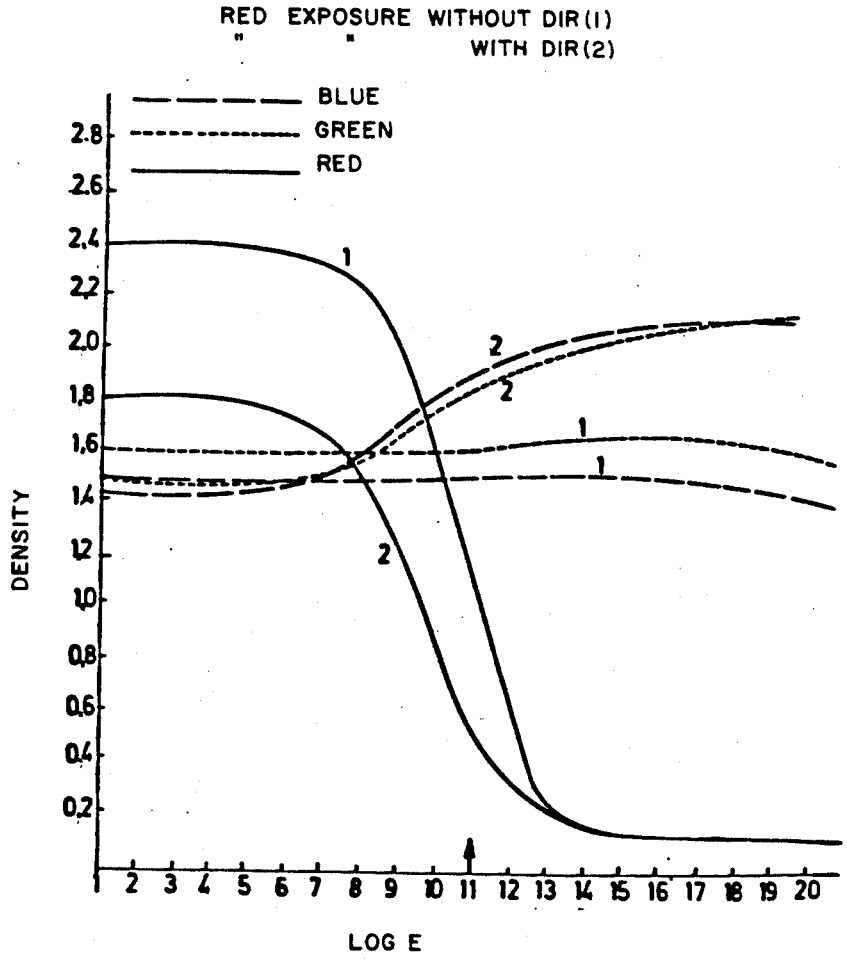
Figure 5:
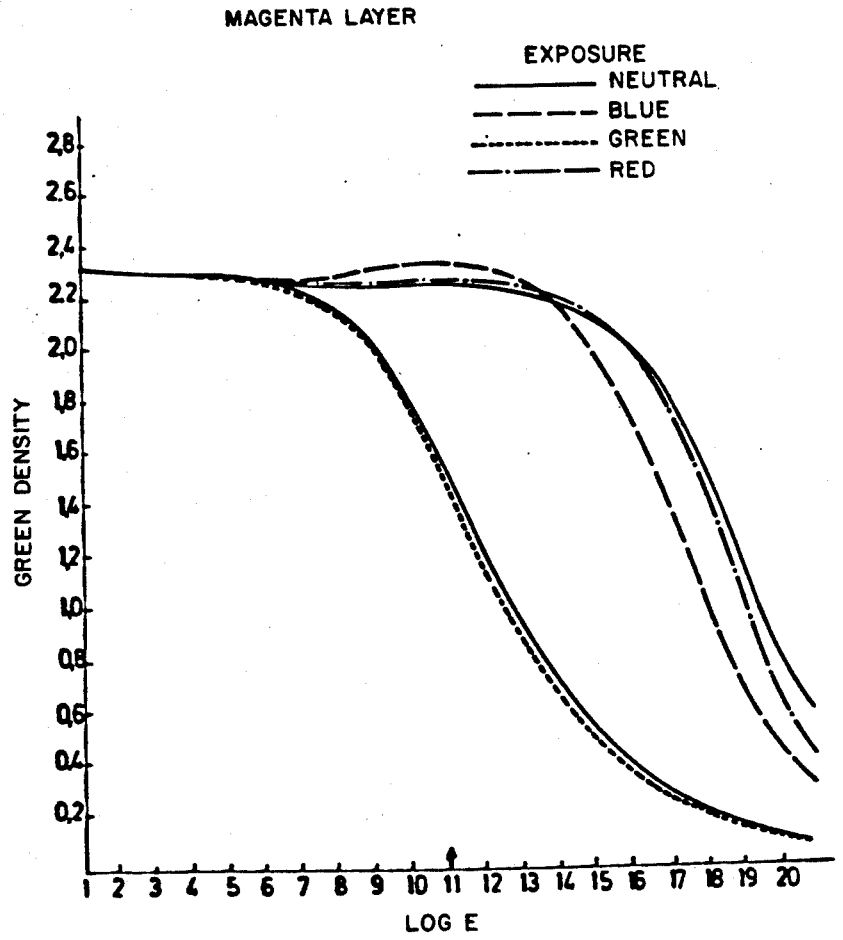

COLOR IMAGE-FORMING PHOTOGRAPHIC REVERSAL ELEMENT WITH IMPROVED INTERIMAGE EFFECTS

The present invention is directed to the improvement of interimage effect for better color reproduction in reversal photographic elements for color photography. More specifically, this invention is directed to a color image-forming photographic reversal element with improved interimage effects.

A photographic element for color photography usually comprises three silver halide photosensitive units sensitive to blue, green and red light respectively associated with yellow, magenta and cyan dye-forming compounds. Particularly useful dye-forming compounds are color-forming couplers. With this type of material, it is well known that color reproduction is often imperfect because of unwanted absorption of the dyes formed from the couplers. Furthermore, during processing, the development of silver halide in one of the emulsion layers may affect dye formation in an adjacent layer according to mechanisms described hereinafter.

In elements for color photography having three units with incorporated couplers, the three units respectively sensitive to blue, green and red light should be protected from undesirable interactions during storage, exposure and development with a view to obtaining excellent color reproduction. In addition, the spectral absorption of the dye formed from each incorporated color-forming coupler should be located in an appropriate wavelength range. These are well-known conditions to form a satisfactory color image.

However, it is also known that elements for color photography exhibit various defects related to the difficulty of meeting these requirements.

One of the defects relating to color image reproduction is that the spectral-absorption characteristics of the subtractive color images obtained from color-forming couplers are not satisfactory; i.e., the light absorption of the dye is not confined to a desired region of the spectrum and extends to other regions of shorter or longer wavelengths. This defect results in reduced color saturation.

Another defect arises because, during color development of the three color image-forming emulsion layers, the development of an image in one of the layers may cause unwanted formation of stain in an adjacent emulsion layer intended by definition to record another image. For example, the development of the magenta image of the green-sensitive layer may cause formation of cyan dye in the red-sensitive layer, but following the pattern of the magenta image. This defect results from the fact that the oxidation products of development of one of the layers may diffuse to an adjacent layer where they would give rise to an unwanted coupling with the coupler present in this layer.

The above-mentioned defects cause what is sometimes referred to by the term "color contamination". The reaction for forming a dye image in a given emulsion layer affects the adjacent emulsion layers whereby the latter lose their aptitude to form independent elementary images and causes in these layers the formation of unwanted dye images by color contamination.

Because the problem has been acknowledged for a long time, various means have been recommended in the prior art to reduce or eliminate these color-contamination defects. For example, it has been proposed to incorporate in color image-forming photographic materials intermediate layers, or filter layers, comprising reducing compounds such as a hydroquinone or a phenol derivative, a scavenger for oxidized color-developing agent, couplers forming colorless compounds, or colored couplers forming diffusible dyes. However, none of these methods has been completely satisfactory.

Other methods of attempting to obtain correct color reproduction consist in employing means having a color-corrective function. For example, a colored coupler which functions as a mask may be used as described, for example, in U.S. Pat. Nos. 2,449,966, 2,445,170, 2,600,606 and 3,148,062 and British Pat. No. 1,044,778. However, this method cannot be applied to direct-positive color photographic materials because the unexposed areas would also be colored.

Another method employs a development inhibitor-releasing, or DIR coupler, as described by Barr, Thirtle and Vittum in *Photog. Sc. and Eng.*, Vol. 13, pages 74 to 80 and 214 to 217 (1969), and in U.S. Pat. No. 3,227,554. Generally, the DIR coupler releases in a layer an inhibitor pattern in accordance with the image formed in this layer, but which migrates into an adjacent layer. Thus, the DIR coupler provides a correction effect usually designated as an interimage effect. The color-correction effect due to the DIR coupler actually results from the combination of several factors such as speed of the DIR-coupler reaction, the activity of the splittable group, the aptitude of the released inhibitor to diffuse in a photosensitive layer, the speed of development of each component of the photosensitive emulsion, the coupling activity of the couplers present in the same layer or in other layers, etc. Many uses of DIR couplers have been proposed in color photographic materials comprising units with several emulsion layers, e.g., a fast layer and a slow layer, as described, for example, in French Pat. No. 2,222,674 and U.S. Pat. No. 4,310,621. This correction by means of DIR couplers provides an interimage effect, but with a strong intralayer inhibiting effect on development, which necessitates a substantial increase in silver coverage. Because the DIR coupler has a limiting effect on development, the use of such a coupler reduces contrast and maximum density.

To reduce color contamination, fogged emulsions may also be used, particularly emulsions consisting of internally fogged grains or internal latent-image emulsions. However, these methods in which fogged silver halide emulsions are used suffer from the difficulty of controlling the photographic properties of these emulsions.

Another method consists in changing the composition of the halides used in each layer respectively sensitive to blue, green and red light of the color photographic material by adjusting, for example, the proportion of iodide ions used in relation to bromide ions. This correction method is that traditionally used for color printing photographic materials, and consists in causing an interimage effect during the first black-and-white development by the action of the iodide ions released from the developing silver haloiodide emulsions. In such a system, interimage effects are not desired in the color developer because of the restraining effect the iodide ions have on color development. In this method, however, the emulsion layers containing iodide ions are both causing and receiving interimage effects, which renders the control of this effect more difficult.

The very multiplicity of correction methods indicates that none of them has been fully satisfactory. This is also true for other methods known to have an influence on color correction, such as methods which vary proportions of developing agents, sulfite ions, hydrogen ions, buffering agents, etc.

Positive dye image-forming reversal photographic materials have features different from those of negative dye image-forming photographic materials. Negative materials are processed, after image exposure, directly with a chromogenic developer which color-develops the negative exposed areas. On the other hand, reversal materials, after imagewise exposure, are first processed with a black-and-white developer which develops a silver image in the negative exposed areas. This is followed by a reversal fogging step, a second overall exposure or a chemical fogging step, and then development with a chromogenic developer to form a positive color image.

In negative dye image-forming photographic materials, interimage effects are always obtained during chromogenic development. In positive dye image-forming reversal photographic materials, interimage effects are generally obtained, as mentioned above, during processing by the release in the first black-and-white developer of a development inhibitor as a function of the silver development of the image-forming layers. The most generally used development inhibitor consists of iodide ions released as a result of the development of silver haloiodide, for example, silver bromoiodide emulsions.

To obtain interimage effects in dye image-forming reversal photographic materials, the formation of interimage effects in the second chromogenic developer by development inhibitors, such as iodide ions or mercaptans released from incorporated DIR couplers, was generally avoided because poor results are usually obtained. Furthermore, when DIR couplers are incorporated in the dye image-forming layers of reversal photographic materials, they increase the granularity of the color positive images obtained.

However, the usual method to obtain interimage effects in color reversal photographic materials using a development inhibitor during the first black-and-white development is not satisfactory. The effect of a development inhibitor in the first developer results in a lower silver density with, as a consequence, the development in the chromogenic developer of a higher silver density and dye image density.

Thus, the development inhibitors produce mainly interimage effects in high dye-density areas of the positive image, while it is often desirable to obtain interimage effects in low dye-density areas. Consequently, if the interimage effects are increased, the sensitivity measured by neutral exposure is lowered (whereas the sensitivity measured by color exposure remains substantially unchanged).

Therefore, it is desirable to provide color image-forming reversal photographic materials with improved interimage effects.

To obviate the drawbacks observed when, according to the prior art, interimage effects are produced in the first black-and-white developer, it was found, according to the present invention, that improved interimage effects could be obtained by releasing a development inhibitor in the second chromogenic developer. In particular, the present invention provides a lower dye image density and obtains a photographic sensitivity increased by about 0.3 log E, measured by color exposure (whereas the sensitivity measured by neutral exposure remains substantially unchanged), by increasing the interimage effects due to a specific arrangement of interimage effect-forming means.

The present invention is based on the premise that it is desirable to separate the mechanism of color image formation from the mechanism of color correction or interimage effects. Thus, according to the present invention, interimage effects are generated by an emulsion layer which does not participate in the formation of the image. This is in contrast with prior-art methods in which the image-forming layers also cause interimage effects.

The invention applies particularly to printing materials comprised of reversal negative emulsions.

A color image-forming silver halide reversal photographic element according to the invention comprises at least two dye image-forming units, each unit containing at least one photosensitive silver halide layer and a dye image-former characterized in that at least one of the dye image-forming units comprises (1) a first silver halide emulsion layer spectrally sensitized to a given region of the spectrum with which is associated a dye-forming coupler, and (2) a second silver halide emulsion layer spectrally sensitized to a different region of the spectrum than the first and containing an interimage effect-forming means which, upon color development, forms either a colorless compound or a dye which does not substantially take part in the formation of the image.

According to a specifically preferred embodiment, the interimage effect-forming means is a DIR compound or coupler.

FIGS. 1–16 illustrate the interimage effects obtained with the invention and will be described in connection with the Examples hereinafter.

A three-color photographic material according to the invention has, for example, the following schematic structure:

| | |
|---|---|
| (1) | green- and/or red-sensitized emulsion + DIR coupler |
| (2) | blue-sensitized emulsion + yellow-forming coupler |
| (3) | CLS interlayer |
| (4) | red-sensitized emulsion + DIR coupler |
| (5) | interlayer |
| (6) | green-sensitized emulsion + magenta-forming coupler |
| (7) | interlayer |
| (8) | green-sensitized emulsion + DIR coupler |
| (9) | interlayer |
| (10) | red-sensitized emulsion + cyan-forming coupler |
| (11) | polyethylene-coated paper support |

In this material, the dye image-forming units are various interlayers and layers 2, 6 and 10 sensitized to blue, green and red light and containing, respectively, yellow, magenta and cyan image-forming couplers. With layers 2, 6 and 10 are associated, respectively, layers 1, 4 and 8 which are the color-correcting layers according to the invention. The color-correcting layers generating the interimage effects comprise a DIR coupler and an emulsion which is color-sensitized differently from that of the associated image-forming emulsion which receives the interimage effect. Thus, green- and/or red-sensitized layer 1 generates an interimage effect intended for blue-sensitized yellow image-forming layer 2. Likewise, red-sensitized layer 4 generates an interimage effect intended for green-sensitized magenta image-forming layer 6 or for blue-sensitized yellow image-forming layer 2.

In the above structure, the arrangement of the layers may be modified. For example, layers 4 and 6 may be interchanged or layers 8 and 10 may be interchanged.

The interlayers contain a compound for scavenging oxidized developing agent and, if necessary, a means to prevent the released inhibitor from migrating.

DIR couplers are well-known compound and are described, for example, in U.S. Pat. No. 3,227,554. These DIR couplers may be color-forming couplers which react with oxidized color-developing agent to form dyes and release diffusible development inhibitors in response to the development of silver halide. The inhibitors released can be mercaptans which diffuse to one or more dye image-forming layers and thus contribute to the formation of the desired interimage effects. In certain instances, DIR couplers are chosen so that, after release of the inhibitor, they form either a colorless compound or a compound which does not affect color reproduction (e.g., a dye identical with that formed in the image layer).

Other compounds capable of releasing in the same manner a development inhibitor by a redox mechanism upon color development may also be used.

As previously mentioned, when the interimage effect-forming means forms a dye during chromogenic development, this dye does not form a substantial image in comparison with the image formed by the dye-forming coupler. For this purpose and according to a particularly preferred embodiment, the interimage effect-forming means is used at a coverage between 5 and 30 percent of the coverage of the dye-forming coupler.

In a color reversal photographic material corresponding to the above schematic structure, interimage effects are produced in the chromogenic developer, after the black-and-white development, in the following manner. Considering layers 8 and 10, after an imagewise neutral exposure, layer 8 would release inhibitor imagewise and would inhibit development in layer 10 accordingly. After an imagewise red exposure, layer 8 would develop completely and would release the development inhibitor nonimagewise. Relative to the neutral exposure, this would increase the development inhibition in layer 10 in the high level of red exposure, thus increasing the effective speed of layer 10 to red light and also increasing color saturation.

Silver halide negative emulsions of photographic materials giving reversal color images are well known. The reversal photographic films and papers according to the invention are reversal films and papers with non-diffusible incorporated couplers, such as Ektachrome Films and Ektachrome Papers of the Eastman Kodak Company.

The silver halide photosensitive emulsions of the photographic materials according to the invention can contain any photosensitive silver halide such as silver chloride, silver bromide or iodide or mixed silver halides such as silver chloroiodide, bromoiodide or chlorobromoiodide, etc.

According to an advantageous embodiment, there can be an interlayer between the image-forming layer and the interimage effect-generating layer. As mentioned above, this interlayer can contain a compound for scavenging oxidized developing agent.

According to various advantageous embodiments, the image-forming silver halide photosensitive emulsion layers are coated at a silver coverage in the range of from 0.5 mg/dm$^2$ to 20 mg/dm$^2$, more particularly from 2 mg/dm$^2$ to 10 mg/dm$^2$, and the interimage effect-generating emulsion layers are coated at a silver coverage in the range of from 0.1 mg/dm$^2$ to 10 mg/dm$^2$, more particularly from 0.5 mg/dm$^2$ to 5 mg/dm$^2$.

According to various advantageous embodiments, the photographic material of the invention is a color reversal photographic material comprising at least one negative dye image-forming silver haloiodide photosensitive emulsion layer, which permits interimage effects to be obtained by action of the iodide in the first black-and-white development step.

In the following embodiments, the yellow dye image-forming layer is in contact with the support, which is advantageous for the absence of mottle in reversal printing paper.

Two general structures of reversal printing paper were prepared as follows:

STRUCTURE 1

(1) antiabrasion layer
(2) UV-absorbing compound layer
(3) red-sensitized emulsion+cyan-forming coupler
(4) interlayer
(5) blue-sensitized emulsion+DIR coupler
(6) interlayer
(7) green-sensitized emulsion+magenta-forming coupler
(8) interlayer
(9) red-sensitized emulsion+DIR coupler
(10) interlayer
(11) blue-sensitized emulsion+yellow-forming coupler
(12) polyethylene-coated paper support This structure is prepared using silver bromoiodide emulsions having tabular grains so that the red- and green-sensitized emulsions have a low sensitivity to blue light. Silver bromoiodide emulsions having tabular grains are well known and are described, in particular, in French Patent Application No. 8218742. The green-sensitized emulsion of layer 7 has a relatively high iodide content in the range from 3 to 6 percent, whereas the red-sensitized emulsion of layer 3 and the blue-sensitized emulsion of layer 11 have a low iodide content in the range from 0 to 2 percent.

In the first black-and-white development step, green-sensitized emulsion layer 7 causes a green-on-blue interimage effect in layer 11 and a green-on-red interimage effect in layer 3. In the color-development step, layers 3, 7 and 11 are interimage effect-receiving layers. In the color-development step, layer 5 causes a blue-on-green interimage effect in layer 7 and a blue-on-red interimage effect in layer 3, while layer 9 causes a red-on-green interimage effect in layer 7 and a red-on-blue interimage effect in layer 11.

The above structure 1 illustrates another advantage of the present invention, which is the formation of chemical edge effects due to the diffusion of development inhibitor through the interlayer between the layer containing the DIR coupler and the image-forming layer, e.g., through interlayer 8 between layer 9 containing the DIR coupler and image-forming layer 7. Such a structure allows a higher lateral diffusion of the development inhibitor which cannot be obtained if the DIR coupler is incorporated in the image-forming layer.

STRUCTURE 2

(1) antiabrasion layer
(2) blue-sensitized emulsion+DIR coupler
(3) interlayer containing a UV-absorbing compound (4) green-sensitizing emulsion + magenta-forming coupler
(5) interlayer
(6) red-sensitized emulsion + cyan-forming coupler
(7) interlayer
(8) green-sensitized emulsion + DIR coupler
(9) interlayer
( ) blue-sensitized emulsion + yellow-forming coupler
(11) polyethylene-coated paper support In this structure, the emulsion of layer 6 has a high iodide content and, in the first black-and-white development step, causes red-on-green and red-on-blue interimage effects, respectively, in layers 4 and 10. Layer 2 causes a blue-on-green interimage effect in layer 4 during the color-development step and, during this same processing step, layer 8 causes a green-on-blue interimage effect in layer 10 and a green-on-red interimage effect in layer 6.

Other structures of photographic materials according to the invention can be formed by changing the order of the layers.

The photosensitive emulsions of the photographic materials according to the invention may contain a variety of colloid binders, in particular hydrophilic colloid binders such as gelatin and other naturally occurring proteins, synthetic polymers such as polyvinyl alcohol, hydrolyzed polyvinyl acetate, a highly hydrolyzed cellulose ester such as hydrolyzed cellulose acetate up to a residual content in acetyl groups of 19/100 to 26/100, a water-soluble ethanolamine-treated cellulose acetate, a polyacrylamide or an imidized polyacrylamide containing 30/100 to 60/100 by weight of acrylamide and having a specific viscosity of 0.25 to 1.5 zein, a vinyl alcohol polymer containing cyanoacetyl groups such as vinyl alcohol and vinyl cyanoacetate copolymers, copolymers of a protein and a vinyl monomer, an ethyl acrylate, acrylic acid and ethyl methacrylate interpolymer, etc. Hydrophobic polymers may also be used, in particular polymers in an aqueous dispersion, e.g., vinyl polymers in the form of latices, which increase the dimensional stability of photographic materials, in particular polymers such as described in U.S. Pat. Nos. 3,142,586, 3,193,386, 3,062,674, 3,220,844 3,287,289 and 3,411,911.

The photosensitive emulsions of the photographic materials according to the invention can be coated on a variety of supports, in particular a film of cellulose nitrate, cellulose acetate, polyvinyl acetal, poly(ethylene terephthalate), polycarbonate, etc., as well as on paper supports, e.g, those which are partially acetylated or coated with baryta or a polymer of an α-olefin such as polyethylene or propylene.

The photosensitive layers and the other layers of colloid binders of the photographic materials according to the invention can contain various inorganic or organic hardeners, in particular, aldehydes, ketones, carboxylic-acid derivatives, sulfonic esters, sulfonyl halides, vinyl sulfonic ethers, halogenated and epoxy derivatives, aziridines, isocyanates, carbodiimides, polymeric hardeners such as oxidized polysaccharides, etc.

The photographic materials according to the invention can comprise conductive or antistatic layers, e.g., layers containing water-soluble salts such as chlorides, nitrates, etc., layers of metals coated under reduced pressure, layers of ionic polymers such as described in U.S. Pat. Nos. 2,861,056 and 3,206,312 and layers of insoluble inorganic salts such as described in U.S. Pat. No. 3,428,451.

The photographic materials according to the invention can contain plasticizers or lubricants, e.g., polyols such as glycerol as described, for example, in U.S. Pat. No. 2,960,404, fatty acids or fatty-acid esters such as described in U.S. Pat. Nos. 2,588,765 and 3,121,060, silicones such as described in British Pat. No. 955,061, etc.

The photosensitive layers and the other layers of colloid binders of the photographic materials according to the invention can contain anionic surfactants such as saponin, alkylaryl-sulfonates as described in U.S. Pat. No. 2,600,831, amphoteric surfactants such as described in U.S. Pat. No. 3,133,816, reaction products of glycidol and an alkylphenol such as described in British Pat. No. 1,022,878, etc.

The photographic materials according to the invention can contain matting chemical compounds such as zinc oxide, titanium dioxide, silica, starch, polymers in powder form as described in U.S. Pat. Nos. 2,922,101 and 2,761,245, etc.

The photographic materials according to the invention can contain optical brighteners, in particular compounds such as stilbenes, triazines, oxazoles, coumarins, etc. Water-soluble brighteners can be used as described in German Pat. No. 972,067 and U.S. Pat. No. 2,933,390, or aqueous brightener dispersions can be used as described in German Pat. No. 1,150,274, and U.S. Pat. No. 3,406,070, French Pat. No. 1,530,244, etc.

The photographic materials according to the invention can contain light-absorbing compounds, filter dyes, antihalation dyes, etc., as described, for example, in U.S. Pat. Nos. 3,253,921, 2,274,782, 2,527,583 and 2,956,879. Mordanted dyes can also be used as described in U.S. Pat. No. 3,282,699, etc.

The photosensitive layers and the other layers of colloid binders of the photographic materials according to the invention can be coated by various processes, e.g., dip coating, hopper coating, etc. For example, processes such as described in U.S. Pat. Nos. 2,681,284 and 2,761,791 and British Pat. No. 837,095 can be used.

The following examples illustrate the invention:

EXAMPLE 1

The simplified following coating was prepared in order to ascertain that the structure according to the invention is useful to obtain a favorable interimage effect in the case of a reversal material with negative emulsions:

(1) green-sensitized silver bromide (3 mg Ag/dm$^2$) emulsion and gelatin (12 mg/dm$^2$), containing a magenta-forming coupler (3.4 mg/dm$^2$) having the formula hereafter;
(2) layer containing a compound for scavenging oxidized developing agent;
(3) red-sensitized silver bromide (1 mg Ag/dm$^2$) emulsion and gelatin (10 mg/dm$^2$), containing a cyan (0.6 mg/dm$^2$) DIR coupler having the hereafter-disclosed formula (0.6 mg/dm$^2$).

Magenta-forming coupler

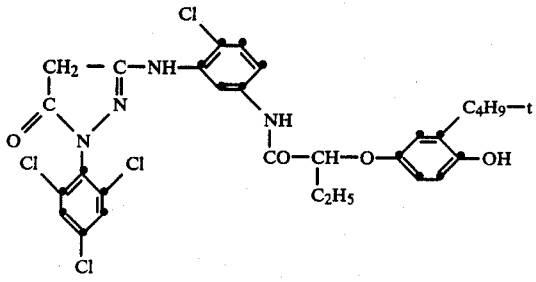

Cyan DIR coupler

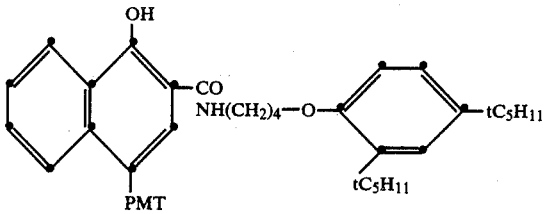

PMT = phenylmercaptotetrazole radical

The compound for scavenging oxidized developing agent is 2,5-bis(1-methylundecyl)hydroquinone.

An identical control coating was prepared in the same manner except that it did not contain the DIR coupler and the magenta-forming layer had a silver coverage of 2.5 mg/dm$^2$.

This coating was exposed for 0.5 sec at 2850° K. to a test object. Then it was processed according to the following sequence at 38° C.

| | |
|---|---|
| black-and-white surface development | 1 min |
| washed | 1 min |
| color-forming development* | 1 min, 30 sec |
| washed | 30 sec |
| bleach-fix | 1 min, 30 sec |
| washed | 2 min, 30 sec |

*The color-forming developer had the following composition:

| | |
|---|---|
| benzyl alcohol | 14.6 ml |
| ethylene glycol | 14 g |
| Dequest 2006 ® from Monsanto (calcium ion complexing agent) | 1.2 g |
| Versenex 80 ® from Dow Chemical (calcium ion complexing agent) | 5.0 g |
| $K_2CO_3$ | 26 g |
| KOH | 1.4 g |
| $Na_2SO_3$ | 1.57 g |
| 3,6-dithiaoctane-1,8-diol | 0.24 g |
| hydroxylamine sulfate | 2.64 g |
| 4-N—ethyl,N—β-(methanesulfonamidoethyl)-2-methyl-p-phenylenediamine sesquisulfate | 5.0 g |
| NaBr | 0.48 g |
| water to make | 1 l |
| pH - 10.45 | |

The surface developer had the following composition:

| | |
|---|---|
| phenidone or 1-phenyl-3-pyrazolidone | 1 g |
| ascorbic acid | 10 g |
| sodium metaborate $8H_2O$ | 60 g |
| potassium bromide | 1 g |
| water to make | 1 l |

The results obtained are illustrated by the graphs of FIG. 1, which show the favorable principal effect (increased sensitivity) for the green exposure and the secondary effect, also favorable, for the red exposure.

EXAMPLE 2

The following three-color material was prepared. The amounts in parentheses are expressed in mg/dm$^2$.

gelatin overcoat (10)

layer containing Tinuvin P® Ciba Geigy, UV-absorbing compound (5.5) and gelatin (9)

Yellow Pack blue-sensitized AgBr emulsion layer (Ag, 3.5; gelatin, 12) containing a yellow-forming coupler (7.8) described hereafter interlayer containing gelatin (10.5), colloidal Carey Lee silver (1.7) and compound for scavenging oxidized developing agent (1.5)

Magenta Pack green-sensitized silver bromide layer (Ag, 3; gelatin, 8.5) containing the magenta-forming coupler of Example 1 (3.4)

interlayer containing gelatin (6) and compound for scavenging oxidized developing agent (1.5)

interimage effect-causing layer comprising a red-sensitized silver bromide emulsion (Ag, 1; gelatin, 20) and the cyan-forming DIR coupler (1) of Example 1 interlayer comprising a Lippmann emulsion (Ag, 0.5), "grey gel" colloidal silver (Ag, 1.5), gelatin (10.5) and compound for scavenging oxidized developing agent (1.5)

Cyan Pack red-sensitized silver bromide layer (Ag, 3; gelatin, 8.5) containing a cyan-forming coupler (3) disclosed hereafter interlayer containing gelatin (6) and compound for scavenging developing agent (1.5)

interimage effect-causing layer comprising a green-sensitized silver bromide emulsion (Ag, 1; gelatin 20) and a DIR magenta-forming coupler (1) disclosed hereafter polyethylene-coated paper The compound for scavenging oxidized developing agent is 2,5-bis(1-methylundecyl)hydroquinone.

Yellow-forming coupler

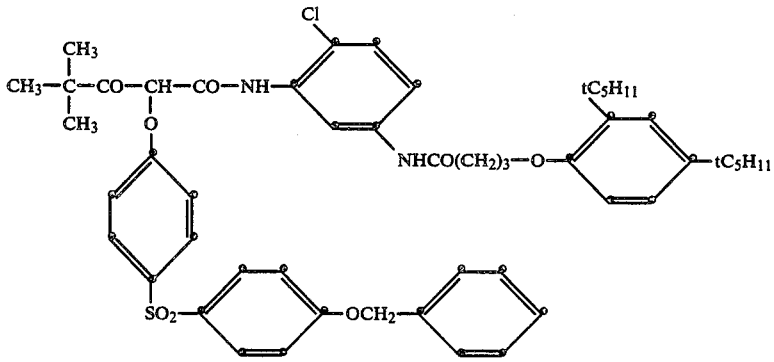

Cyan-forming coupler

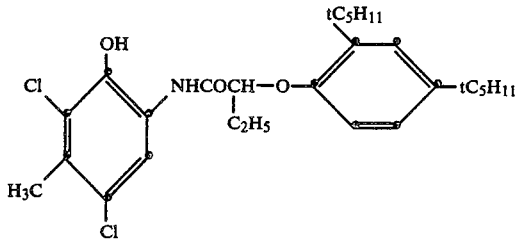

Magenta DIR coupler

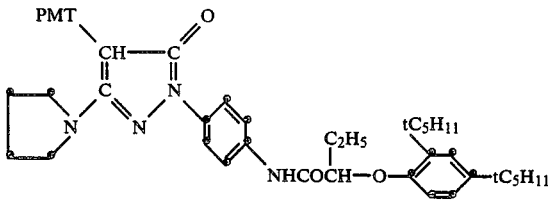

An identical control coating was prepared except that it did not contain any DIR coupler.

The three-color materials were exposed to a color step tablet for 0.5 sec at 2850° K.

The exposed materials were then processed by the procedure of Example 1 above. The favorable interimage effects obtained are shown on the graph of FIGS. 2, 3 and 4. In particular, the effects on the green and red exposures are noticeable. The primary effects (improved sensitivity) are markedly favorable and the important secondary effects are further located in the sensitometric layer modulation area; hence, they are usable.

Advantages

The layer(s) causing the interimage effects can have a sensitivity and a contrast different from the image layer, making it possible to obtain more advantageous effects. In the case of color printing paper, in which interimage effects are caused upon black-and-white development in the first developer, it is possible to add the above technique to improve color quality.

It is possible, therefore, to obtain better adjusted and better controlled independent interimage effects by separating the interimage effect-causing means.

EXAMPLE 3

This example illustrates the production of interimage effects by the action of iodide in the first black-and-white developer and the production of interimage effects in the color developer by a red-sensitized emulsion layer containing a DIR coupler.

The control coating having the following structure was prepared:

| | | |
|---|---|---|
| 1 | gel = 10 g/dm$^2$ | Compound L = 1.5 mg/dm$^2$ |
| | | BVSME = 1.5%/gel |
| 2* | Ag = 3.5 mg/dm$^2$ | |
| | magenta-forming coupler of Ex. 1 = 3.9 mg/dm$^2$ | |
| | | gel = 15 mg/dm$^2$ |
| 3 | gel = 10 mg/dm$^2$ | Compound L = 1.5 mg/dm$^2$ |
| | | BVSME = 1.5%/gel |
| 4 | gel = 12.5 mg/dm$^2$ | |
| 5 | gel = 10 mg/dm$^2$ | Compound L = 1.5 mg/dm$^2$ |
| | | BVSME = 1.5%/gel |
| 6** | Ag = 3.5 mg/dm$^2$ | Compound L = 0.5 mg/dm$^2$ |
| | yellow-forming coupler of Ex. 2 = 8.5 mg/dm$^2$ | |
| | | gel = 15 mg/dm$^2$ |

Polyethylene-coated paper support
*green-sensitized single-component emulsion with tabular grains of Example 1 of French Patent Application 8218742 containing 3 to 5% mole iodide
**blue-sensitized emulsion blend with tabular grains containing 1% mole iodide
Compound L = 2.5 bis(1-methylundecyl)hydroquinone
The hardening agent BVSME is bis(vinylsulfonylmethyl) ether.

A photographic material according to the invention was prepared with a red-sensitized emulsion containing a cyan DIR coupler:

| | | |
|---|---|---|
| 1 | gel = 10 g/dm$^2$ | Compound L = 1.5 mg/dm$^2$ |
| | | BVSME = 1.5%/gel |
| 2* | Ag = 4.5 mg/dm$^2$ | gel = 15.00 mg/dm$^2$ |
| | magenta-forming coupler of Ex. 1 = 3.9 mg/dm$^2$ | |
| 3 | gel = 10 mg/dm$^2$ | Compound L = 1.5 mg/dm$^2$ |
| | | BVSME = 1.5%/gel |
| 4** | Ag = 1 mg/dm$^2$ | |
| | cyan DIR coupler = 1.5 mg/dm$^2$ | |
| | gel = 12.50 mg/dm$^2$ | |
| 5 | gel = 10 mg/dm$^2$ | Compound L = 1.5 mg/dm$^2$ |
| | | BVSME = 1.5%/gel |
| 6*** | Ag = 4 mg/dm$^2$ | Compound L = 0.5 mg/dm$^2$ |
| | yellow-forming coupler of Ex. 2 = 8.5 mg/dm$^2$ | |
| | | gel = 15 mg/dm$^2$ |

Polyethylene-coated paper support
*green-sensitized single-component emulsion with tabular grains containing 3 to 5% mole iodide
**red-sensitized single-component emulsion with tabular grains
***blue-sensitized emulsion blend with tabular grains containing 1% mole iodide Cyan DIR coupler

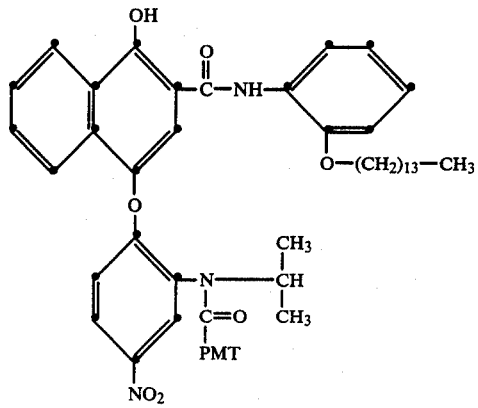

Samples of these materials were given step exposures. Five sensitometric curves were obtained, exposed in the following manner:

(1) Neutral, additive exposure, 0.5 sec, blue+green+red
Blue: wratten filter 98+1.00 neutral density
Green: wratten filter 99+0.10 neutral density
Red: wratten filter 29+0.70 neutral density (2) Shifted neutral: additive exposure, (blue+ND=1*)+(green+ND=1)+(red+ND=1)

(3) Blue test object: additive exposure, blue+(green+ND=1)+(red+ND=1)

(4) Green test object: additive exposure, (blue+ND=1)+green+(red+ND=1)

(5) Red test object: additive exposure, (blue+ND=1)+(green+ND=1)+red

*ND=1 means: neutral density 1.00

Processing

| | |
|---|---|
| first developer (black-and-white) | 1 min at 38° C. |
| washed | 1 min, 30 sec |
| color developer | 2 min at 38° C. |
| washed | 30 sec |
| bleach-fix | 2 min |

First Black-and-White Developer

| | |
|---|---|
| Dequest 2006 ® from Monsanto | 1.41 g |
| Versenex 80 ® from Dow Chemical | 8.25 g |
| $K_2SO_3$ | 30.0 g |
| KSCN | 1.0 g |
| KOH | 9.0 g |
| 1-phenyl-4,4-dimethyl-3-pyrazolidone | 1.5 g |
| $K_2CO_3$ | 14.0 g |
| $NaHCO_3$ | 12.0 g |
| hydroquinone sodium monosulfonate | 23.3 g |
| NaBr | 2.4 g |
| KI | 0.008 g |
| water to make | 1 l |
| pH = 9.65 | |

The composition of the color developer is given in Example 1.

Bleach-Fix Bath

| | |
|---|---|
| 1.56 m solution of the ammonium salt of ethylenediamine tetraacetic acid ferric complex | 115 ml |
| sodium metabisulfite | 15.4 g |
| ammonium thiosulfate (58%) | 126 ml |
| 1,2,4-triazole-3-thiol | 0.377 g |
| water to make | 1 l |
| pH = 6.5 | |

Results

Magenta layer (FIG. 5) control coating: no interimage effect.

Figure 6:
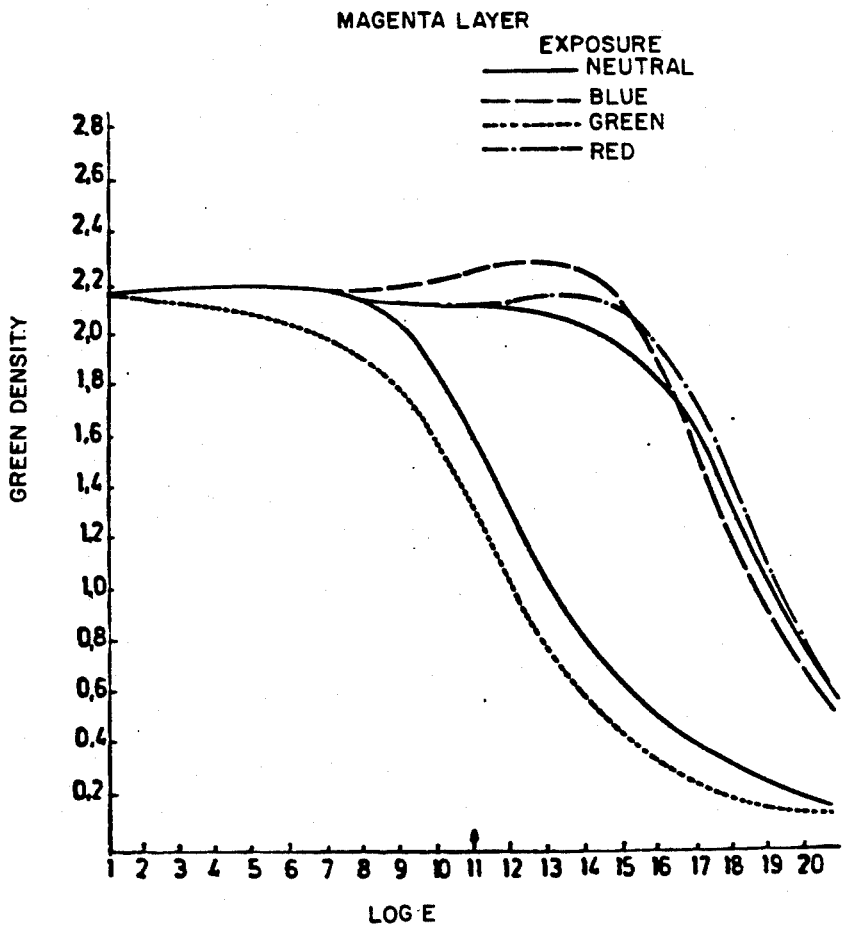

FIG. 6—The sensitivity of the exposure to green is higher than neutral exposure which results in a brighter color of the reproduction of the green test object.

Yellow layer

Figure 7:
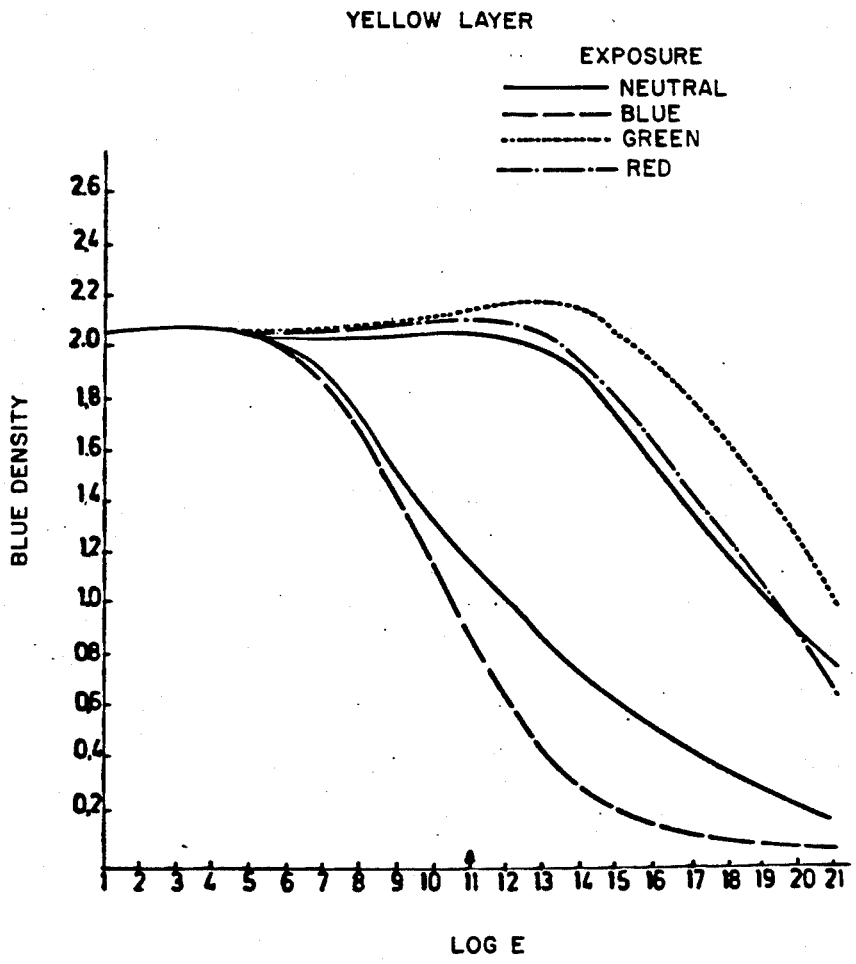

FIG. 7—Control coating: This figure shows the interimage effects caused by iodide; the exposure to blue is more sensitive than the neutral one (purer reproduction of the blue test object), and the maximum density is higher in the exposure to green than in the shifted neutral (reproduction of the test object more saturated in yellow).

Figure 8:
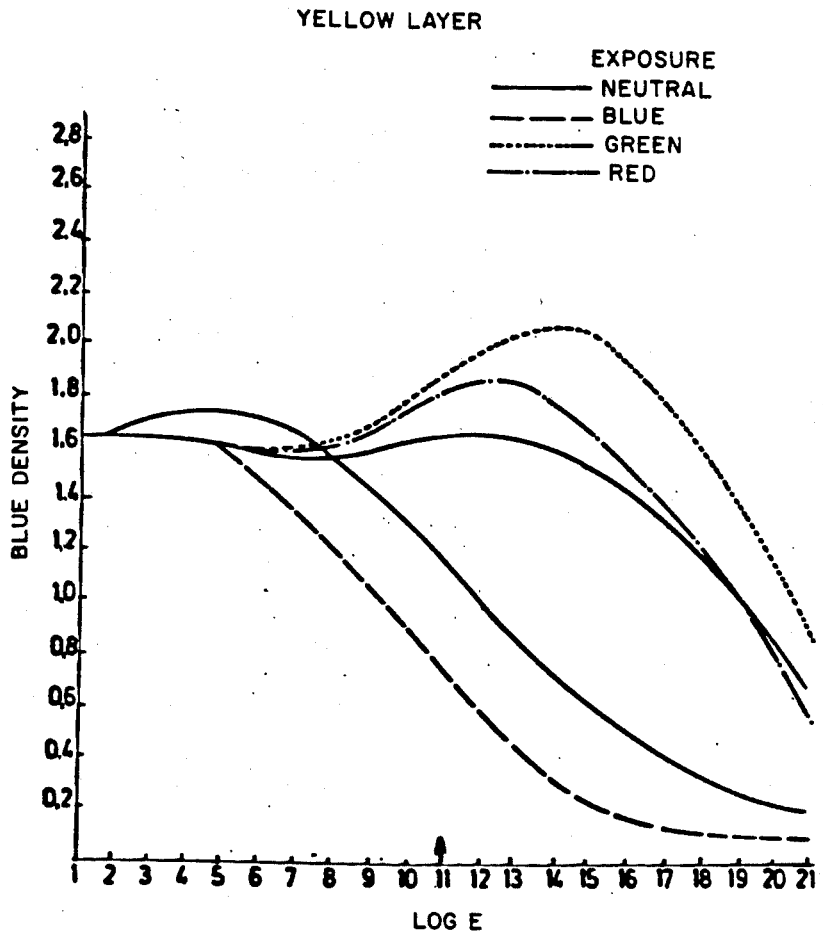

FIG. 8—The interimage effects caused by the layer containing the DIR coupler have been added to those caused by iodide. The exposure to blue is much more sensitive than the neutral one, and the maximum density of the red exposure is higher than that of the shifted neutral.

EXAMPLE 4

This example illustrates the interimage effects caused on a magenta layer by blue- and red-sensitized associated layers containing a DIR coupler.

The control material having the following structure was prepared:

| | | |
|---|---|---|
| 1 | gel = 10 g/dm$^2$ | Compound L = 1.5 mg/dm$^2$ BVSME = 1.5%/gel |
| 2* | Ag = 1 mg/dm$^2$ | gel = 12.5 mg/dm$^2$ |
| 3 | gel = 10 mg/dm$^2$ | Compound L = 1.5 mg/dm$^2$ BVSME = 1.5%/gel |
| 4** | Ag = 3.5 mg/dm$^2$ | gel = 15 mg/dm$^2$ magenta-forming coupler of Ex. 1 = 3.9 mg/dm$^2$ |
| 5 | gel = 10 mg/dm$^2$ | Compound L = 1.5 mg/dm$^2$ BVSME = 1.5%/gel |
| 6*** | Ag = 1 mg/dm$^2$ | gel = 12.50 mg/dm$^2$ |

Polyethylene-coated paper support
*blue-sensitized single-component emulsion with tabular grains
**green-sensitized single-component emulsion with tabular grains
***red-sensitized single-component emulsion with tabular grains Material 1 According to the Invention It is identical to the control material except the layer 6 contains 1.5 mg/dm$^2$ of cyan DIR coupler of Example 3.

Material 2 According to the Invention

It is the same as the control material, but in this case layer 2 contains 1.2 mg/dm$^2$ of cyan DIR coupler of Example 3.

Material 3 According to the Invention

Layers 6 and 2, respectively, contain 1.5 and 1.2 mg/dm$^2$ of cyan DIR coupler of Example 3.

Figure 9:
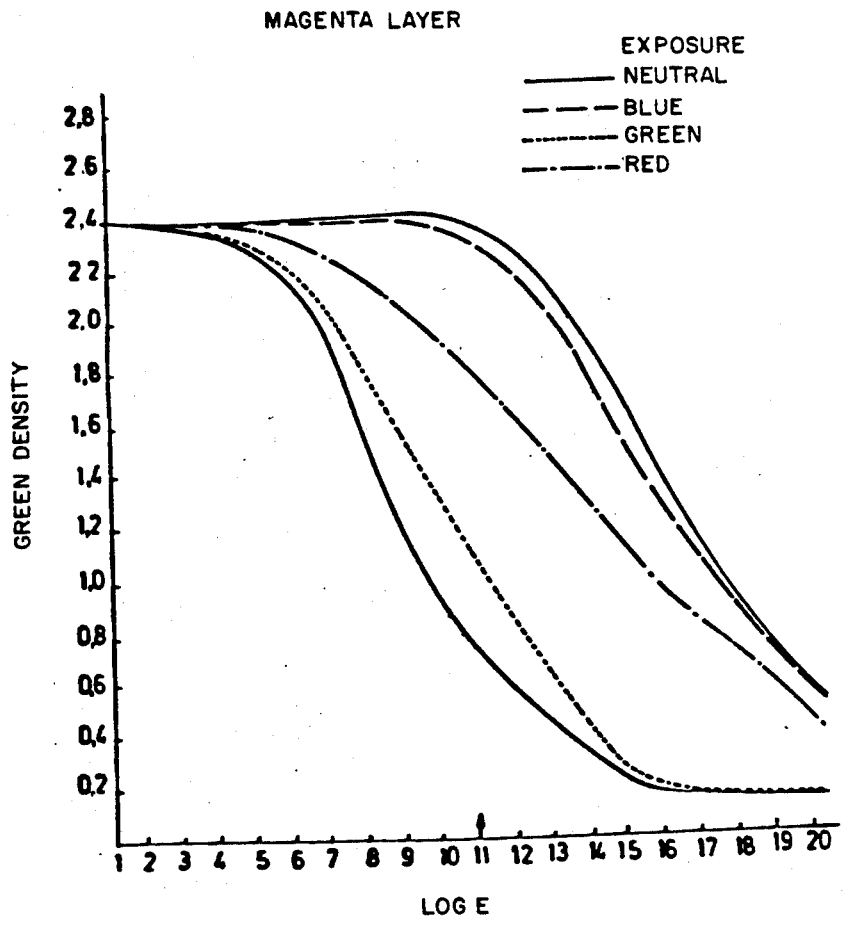

FIG. 9—Control Material

The curve representing green exposure is shifted with respect to the curve of neutral exposure, giving a darker green object. Likewise, the shifting of the curve representing red exposure with respect to the curve of shifted neutral gives a less saturated red object.

Figure 10:
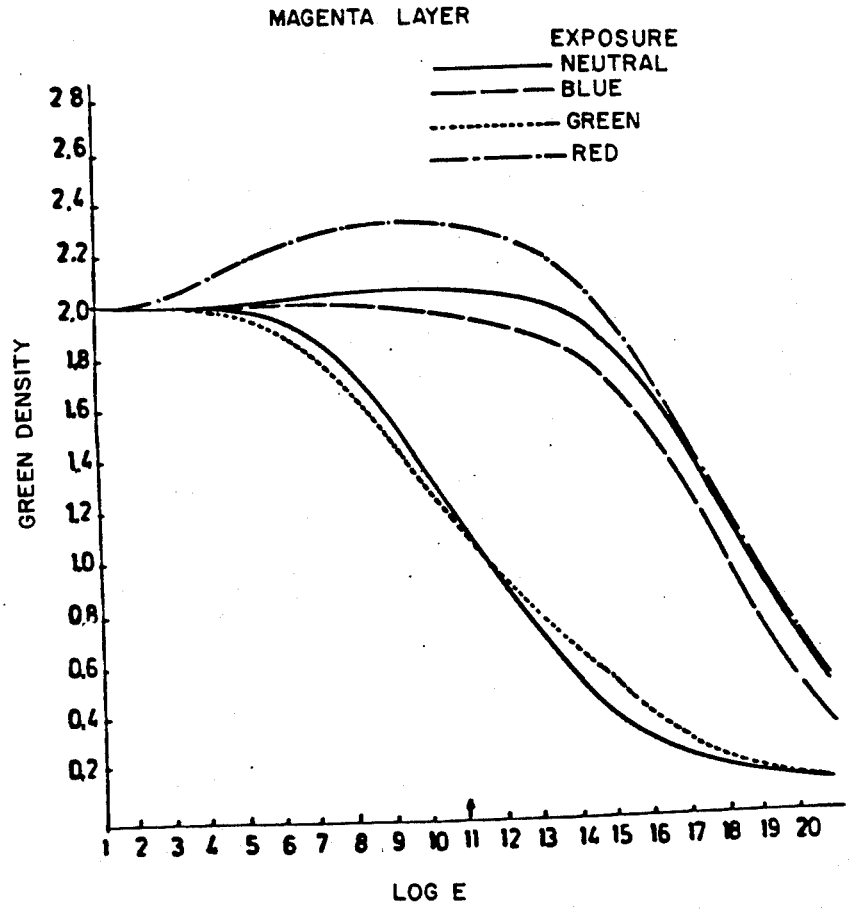

FIG. 10—Material 1 According to the Invention

Interimage effects are caused by the red-sensitized layer. The poor color rendition of the control material is improved (substantially no effect for the exposure to green); a favorable effect is observed even for exposure to red.

Figure 11:
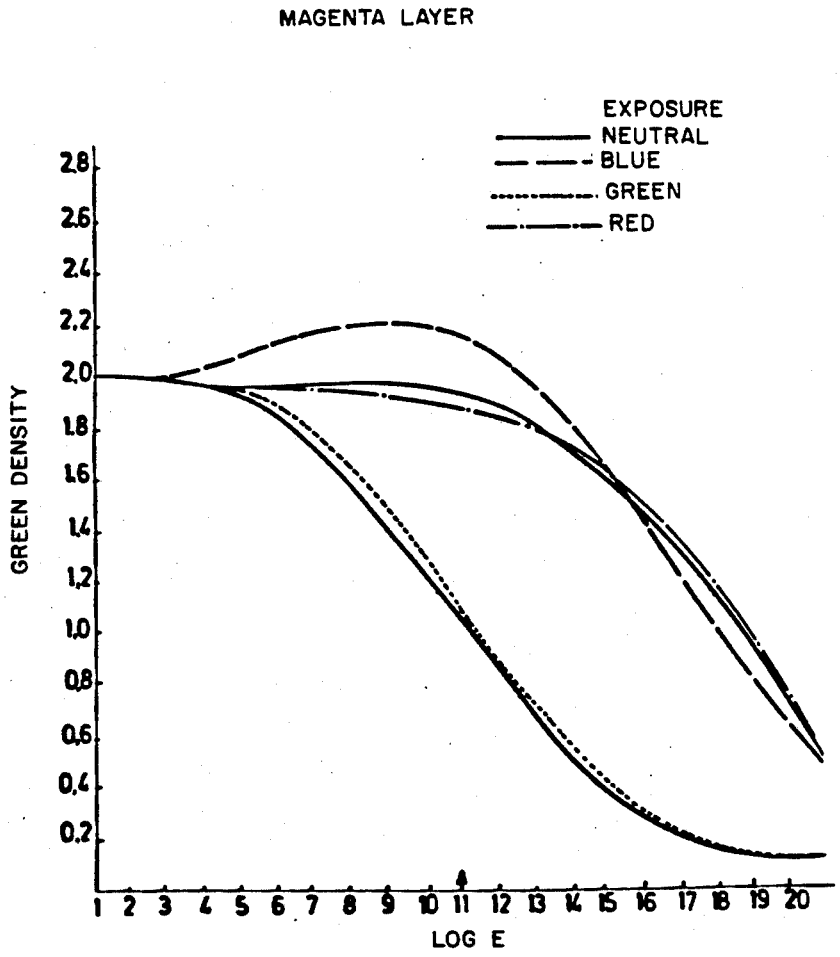

FIG. 11—Material 2 According to the Invention

Interimage effects are caused by the blue-sensitized layer. The poor rendition of green is improved and a favorable effect is noted for exposure to blue.

Figure 12:
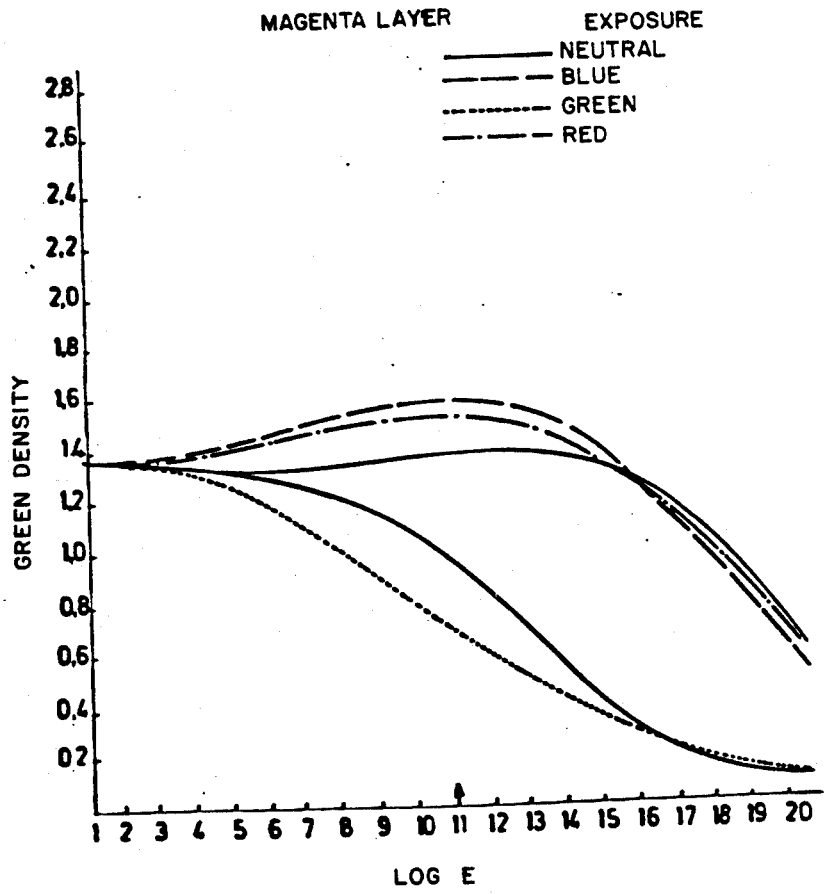
Figure 13:
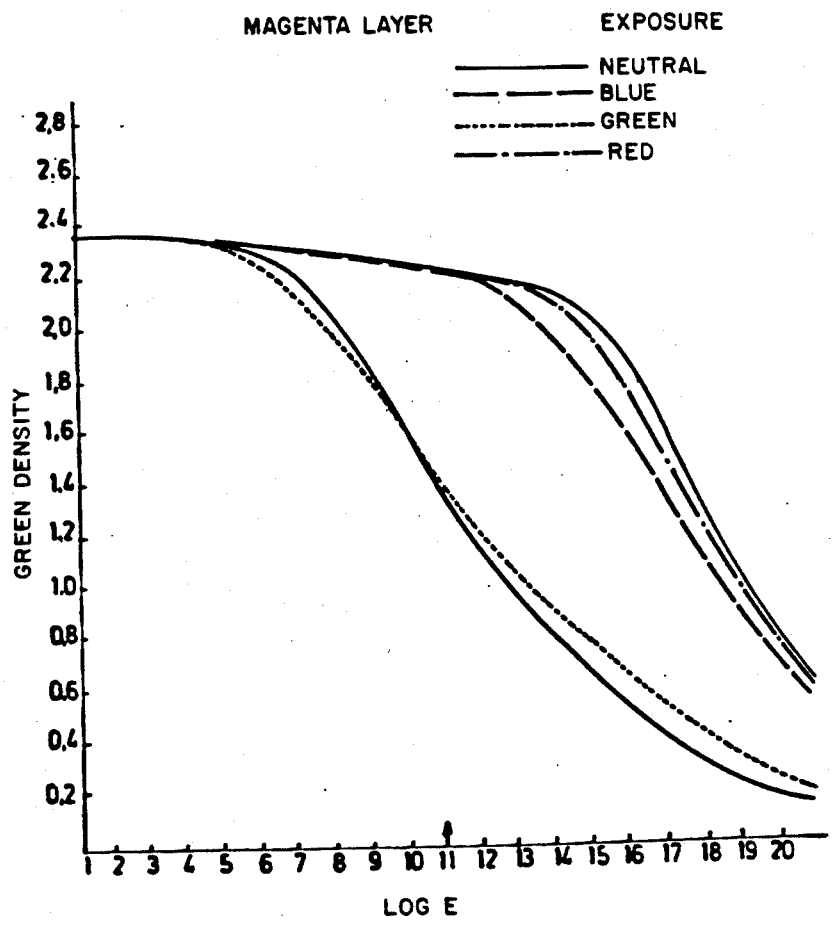
Figure 14:
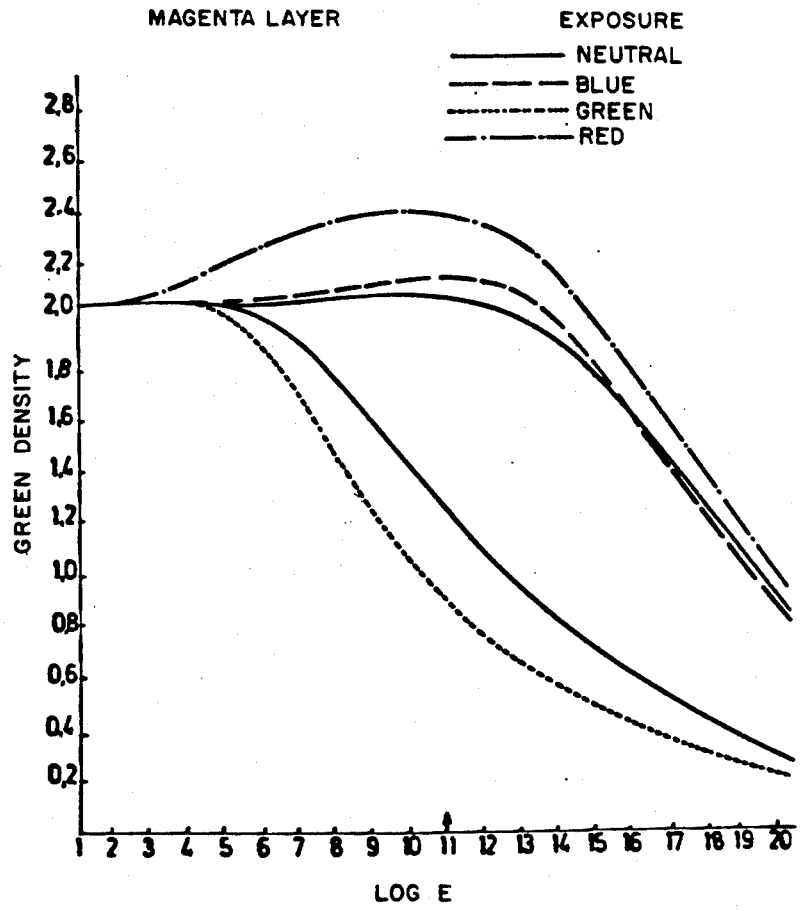

FIG. 12—Material 3 According to the Invention

Interimage effects are caused by the two layers with DIR couplers. Lowering of the Dmax can be compensated for by increasing the Ag coverage of the image layers. Favorable effects are produced for three-color exposures.

EXAMPLE 5

This example is similar to Example 4 except that layer 2 of material 3 contains, instead of cyan DIR coupler of Example 3, 1.5 mg/dm$^2$ of a yellow DIR coupler of the following formula:

Yellow DIR coupler

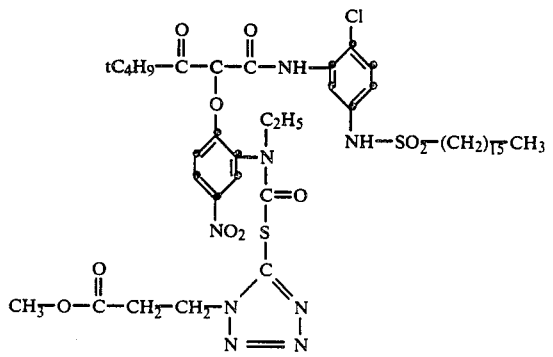

Results

It is noted that the control material (FIG. 13) does not exhibit interimage effects.

The material according to the invention with DIR couplers (FIG. 14) retains a Dmax similar to the control and exhibits favorable interimage effects.

EXAMPLE 6

This example illustrates the use of a compound capable of releasing an inhibitor by a redox mechanism during color development.

The control material had the following structure:

| | | |
|---|---|---|
| 1 | gel = 10 g/dm$^2$ | Compound L = 1.5 mg/dm$^2$ |
| | BVSME = 1.5%/gel | |
| 2* | Ag = 1 mg/dm$^2$ | gel = 12.5 mg/dm$^2$ |
| | cyan DIR coupler of Example 3 = 0.8 mg/dm$^2$ | |
| 3 | gel = 10 mg/dm$^2$ | Compound L = 1.5 mg/dm$^2$ |
| | BVSME = 1.5%/gel | |
| 4** | Ag = 4 mg/dm$^2$ | gel = 12.50 mg/dm$^2$ |
| | | Compound L = 0.5 mg/dm$^2$ |
| | yellow-forming coupler of Example 2 = 10 mg/dm$^2$ | |

Polyethylene-coated paper support

*red-sensitized single-component emulsion with tabular grains

**blue-sensitized emulsion blend with tabular grains

Material According to the Invention

It is identical to the control except for the layer 2 in which the cyan DIR coupler of Example 3 has been replaced by 1 mg/dm$^2$ of the following compound:

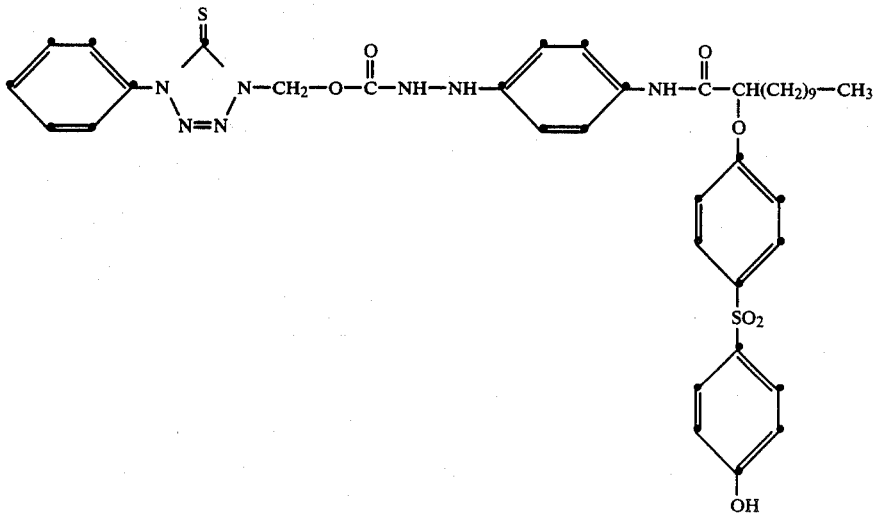

Results

Figure 15:
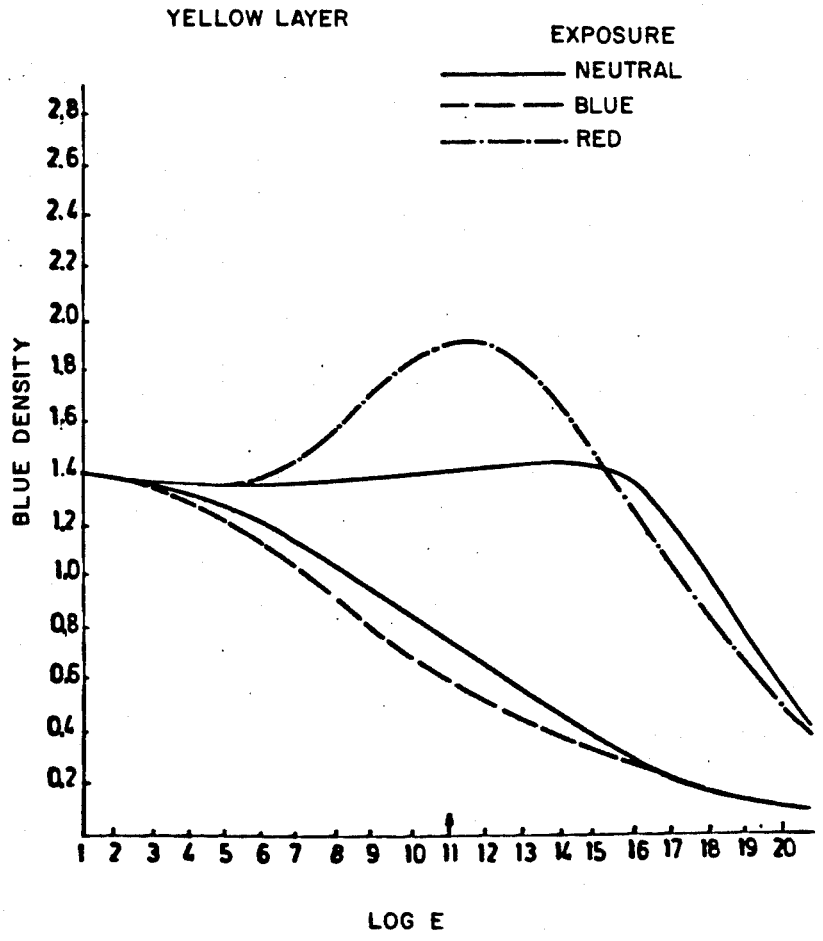
Figure 16:
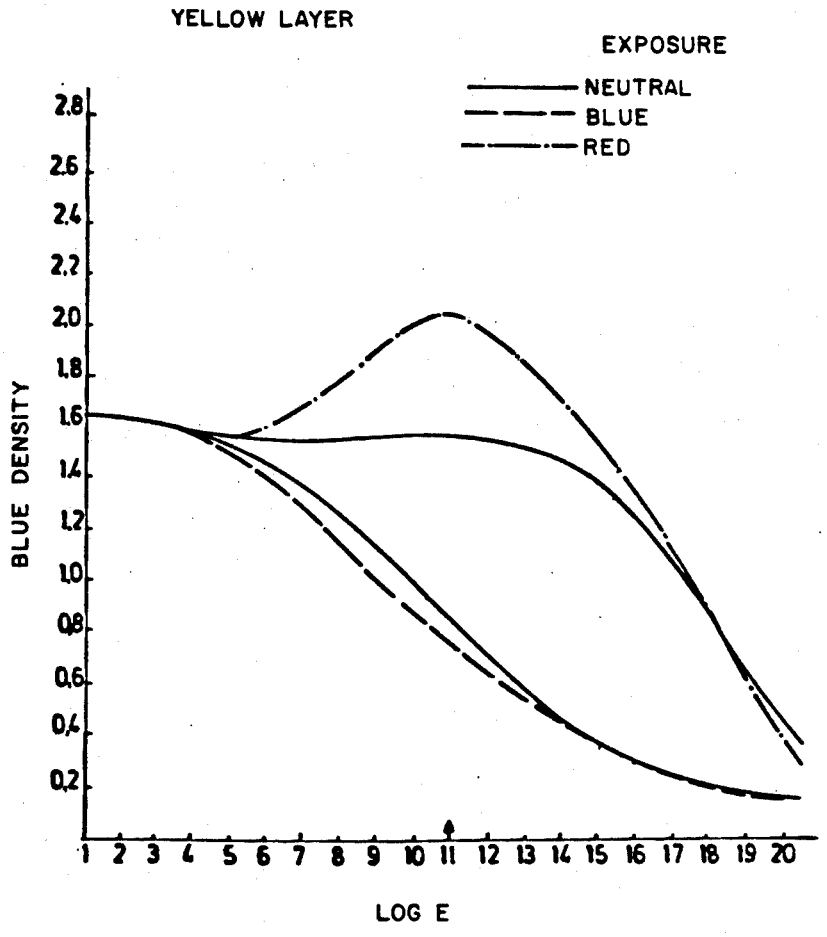

FIGS. 15 and 16 show that the above compound causes interimage effects, for exposures to blue and red, similar to those caused by the cyan DIR coupler of Example 3.

The invention has been described in detail with particular reference to preferred embodiments thereof, but it will be understood that variations and modifications can be effected within the spirit and scope of the invention.

What is claimed is:

1. A color image-forming silver halide reversal photographic element comprising at least two dye image-forming units, each unit containing at least one photosensitive silver halide layer and a dye image-former, wherein at least one of the dye image-forming units comprises (1) a first silver halide emulsion layer spectrally sensitized to a given region of the spectrum with which is associated a dye-forming coupler and (2) a second halide emulsion layer spectrally sensitized to a different region of the spectrum than the first and containing an interimage effect-forming means comprising a development inhibitor-releasing compound or coupler which, upon color development, forms either a colorless compound or a dye which does not substantially take part in the formation of the image, said second silver halide emulsion layer not having a dye-forming coupler which substantially takes part in the formation of the image.

2. The reversal photographic material of claim 1 wherein the interimage effect-forming means is a compound releasing a development inhibitor, upon color development, by a redox mechanism.

3. The reversal photographic material of claim 1 wherein the interimage effect-forming means is present at a coverage of between 5 and 30 percent of the coverage of the dye-forming coupler.

4. The reversal photographic material of claim 1 which comprises a support coated with (a) a blue-sensitive unit containing (1) an interimage effect-causing layer comprising a green- and/or red-sensitized silver halide photosensitive emulsion layer and a development inhibitor-releasing coupler and (2) an interimage effect-receiving layer comprising a blue-sensitized silver halide photosensitive emulsion layer and a yellow-forming coupler, (b) a green-sensitive unit containing (3) a Carey Lea silver interlayer, (4) an interimage effect-causing layer comprising a red-sensitized silver halide photosensitive emulsion layer and a development inhibitor-releasing coupler, (5) an interlayer and (6) an interimage effect-receiving layer comprising a green-sensitized silver halide photosensitive emulsion layer and a magenta-forming coupler, and (c) a red-sensitive unit containing (7) an interlayer, (8) an interimage effect-causing layer comprising a green-sensitized silver halide photosensitive emulsion layer and a development inhibitor-releasing coupler, (9) an interlayer and (10) an interimage effect-receiving layer comprising a red-sensitized silver halide photosensitive emulsion layer and a cyan-forming coupler.

5. The reversal photographic material of claim 4 wherein layers 4 and 6 are interchanged and layers 8 and 10 are interchanged.

6. The reversal photographic material of claim 4 wherein the interlayers contain a scavenger for oxidized development agent.

7. The reversal photographic material of claim 4 wherein each silver halide photosensitive emulsion is a negative-working emulsion.

8. The reversal photographic material of claim 7 wherein at least one of the dye image-forming photosensitive emulsion layer is a silver haloiodide emulsion layer.

9. The reversal photographic material of claim 1 wherein the silver halide emulsion layer spectrally sensitized to a different region of the spectrum which contains said interimage effect-forming means forms the interimage effects during the second development which is the color development.

10. The reversal photographic material of claim 1 which comprises a support coated with (1) an antiabrasion layer, (2) a layer containing an ultraviolet-absorbing compound, (3) a red-sensitized silver halide photosensitive emulsion layer and a cyan-forming coupler, (4) an interlayer, (5) a blue-sensitized emulsion layer and a development inhibitor-releasing coupler, (6) an interlayer, (7) a green-sensitized silver haloiodide photosensitive emulsion layer and a magenta-forming coupler, (8) an interlayer, (9) a red-sensitized silver halide photosensitive emulsion layer and a development inhibitor-releasing coupler, (10) an interlayer and (11) a blue-sensitized silver halide photosensitive emulsion layer and a yellow-forming coupler.

11. The reversal photographic material of claim 1 which comprises a polyethylene-coated paper support coated with (1) an antiabrasion layer, (2) a blue-sensitized silver halide photosensitive emulsion layer and a development inhibitor-releasing coupler, (3) an interlayer with an ultraviolet-absorbing compound, (4) a green-sensitized silver halide photosensitive emulsion layer and a magenta-forming coupler, (5) an interlayer, (6) a red-sensitized silver haloiodide photosensitive emulsion layer and a cyan-forming coupler, (7) an interlayer, (8) a green-sensitized silver halide photosensitive emulsion layer and a development inhibitor-releasing coupler, (9) an interlayer and (10) a blue-sensitized silver halide photosensitive emulsion layer and a yellow-forming coupler.

12. A process for producing a reversal image comprising exposing the photographic element of claim 1, developing said element in a black-and-white developer, washing said element, and then developing said element in a color developer wherein said interimage effect-forming means is released in the color development step.

13. The process of claim of claim 12 wherein the interimage effect-forming means is a compound releasing a development inhibitor, upon color development, by a redox mechanism.

14. The process of claim 12 wherein the interimage effect-forming means is present at a coverage of between 5 and 30 percent of the coverage of the dye-forming coupler.

* * * * *